US008650867B2

(12) United States Patent
Sloss

(10) Patent No.: US 8,650,867 B2
(45) Date of Patent: Feb. 18, 2014

(54) EXHAUST MANIFOLDS INCLUDING HEAT SHIELD ASSEMBLIES

(71) Applicant: Wescast Industries, Inc., Brantford (CA)

(72) Inventor: Clayton A. Sloss, Paris (CA)

(73) Assignee: Wescast Industries Inc., Brantford, ON (CA)

( * ) Notice: Subject to any disclaimer, the term of this patent is extended or adjusted under 35 U.S.C. 154(b) by 0 days.

(21) Appl. No.: 13/769,495

(22) Filed: Feb. 18, 2013

(65) Prior Publication Data

US 2013/0152563 A1 Jun. 20, 2013

Related U.S. Application Data

(63) Continuation of application No. 12/304,325, filed as application No. PCT/IB2007/003519 on Jun. 13, 2007, now Pat. No. 8,413,435.

(60) Provisional application No. 60/813,323, filed on Jun. 13, 2006.

(51) Int. Cl.
*F01N 13/10* (2010.01)

(52) U.S. Cl.
USPC ..... 60/323; 60/321; 60/324

(58) Field of Classification Search
USPC ..... 60/313, 321, 323, 324
See application file for complete search history.

(56) References Cited

U.S. PATENT DOCUMENTS 5,419,127 A * 5/1995 Moore, III ..... 60/322
2005/0072393 A1* 4/2005 Now ..... 123/184.53

* cited by examiner

*Primary Examiner* — Thomas E. Denion
*Assistant Examiner* — Jorge Leon, Jr.
(74) *Attorney, Agent, or Firm* — Harness, Dickey & Pierce, PLC

(57) ABSTRACT

An exhaust manifold including a manifold body made of a first material and at least one heat shield insert provided inside the manifold body and made of a second material. The first material is a low cost material and the second material is a higher grade, temperature-resistant material. The manifold body includes a plurality of runners, collector and an outlet. The shield insert is preferably provided in the collector region adjacent to the outlet. The heat shield insert may have a curved sheet configuration or a tubular configuration depending on applications. The heat shield properly insulates the manifold body from the exhaust gas to protect the manifold body. The exhaust manifold, which is made from a combination of different materials, provides a more cost-effective solution in high temperature applications.

5 Claims, 5 Drawing Sheets

EXHAUST MANIFOLDS INCLUDING HEAT SHIELD ASSEMBLIES

CROSS-REFERENCE TO RELATED APPLICATIONS

This application is a continuation of U.S. Ser. No. 12/304,325, filed on Jan. 27, 2009 which is a National Stage of International Application No. PCT/IB2007/003519, filed Jun. 13, 2007 which claims the benefit of provisional application Ser. No. 60/813,323, filed on Jun. 13, 2006, the entire contents of which are incorporated by reference herein in their entirety.

FIELD

The present disclosure generally relates to exhaust manifolds, and more particularly to exhaust manifolds including heat shield assemblies.

BACKGROUND

Exhaust manifolds are commonly made from cast iron for high volume production engines because for this application cast iron often has advantages in terms of cost, durability, packaging and NVH (noise, vibration, and harshness). Packaging refers to the task of arranging flow paths from each port to a common outlet position while maintaining clearance to other underhood components and providing access for all fasteners during assembly. Among the commonly used cast iron materials for exhaust manifolds is silicon-molybdenum cast iron ("SiMo cast iron"). SiMo cast iron becomes weaker as the temperature increases and is subject to damage from oxidation, decarburization, and coarsening at very high temperatures. The duration of time at high temperature determines the amount of material damage that accumulates. The accumulation of damage and the elevated temperature strength (the thermal strength) of the material are important factors in evaluating the durability of the exhaust component.

As automotive companies increase the gas temperatures of their engines to improve efficiency and reduce exhaust emissions, more manifold applications are exceeding the practical working (temperature) limit of typical cast irons. The temperature distribution in the manifolds is not uniform and some peak temperature areas receive more heat than other areas in the manifolds. Currently, if a material such as SiMo cast iron is inadequate for the peak temperature, the entire manifold has to be made from a higher grade material (e.g., Ni-Resist, cast steel, or fabricated stainless steel). Therefore, the manufacturing costs for exhaust manifolds for high temperature applications are significantly increased.

SUMMARY

Several embodiments described in the present disclosure provide for an exhaust component which is made of composite materials. The exhaust component can be made to have high temperature durability using common cast materials. In one form, an exhaust component for guiding exhaust gas includes a component body and a shield insert. The component body defines a gas chamber and is made of a first material. The shield insert is provided in the gas chamber for protecting a portion of the component body against heat from an exhaust gas received in the gas chamber. The shield insert is made of a second material which is more heat-resistant than the first material.

In another form, an exhaust component for guiding an exhaust gas includes a component body defining a gas chamber and a shield insert disposed in the gas chamber for dividing the gas chamber into a first flow channel and a second flow channel.

In still another form, a method of manufacturing an exhaust component includes providing a mold for casting an exhaust component; inserting a heat shield insert in the mold; and pouring a first material in the mold. The heat shield insert is made of a second material which is more heat-resistant than the first material.

Further areas of applicability of the present invention will become apparent from the detailed description provided hereinafter. It should be understood that the detailed description and specific examples, while indicating the preferred embodiment of the invention, are intended for purposes of illustration only and are not intended to limit the scope of the invention.

DRAWINGS

The drawings described herein are for illustration purposes only and are not intended to limit the scope of the present disclosure in any way.

Corresponding reference numerals indicate corresponding parts throughout the several views of the drawings.

DETAILED DESCRIPTION

Figure 1:
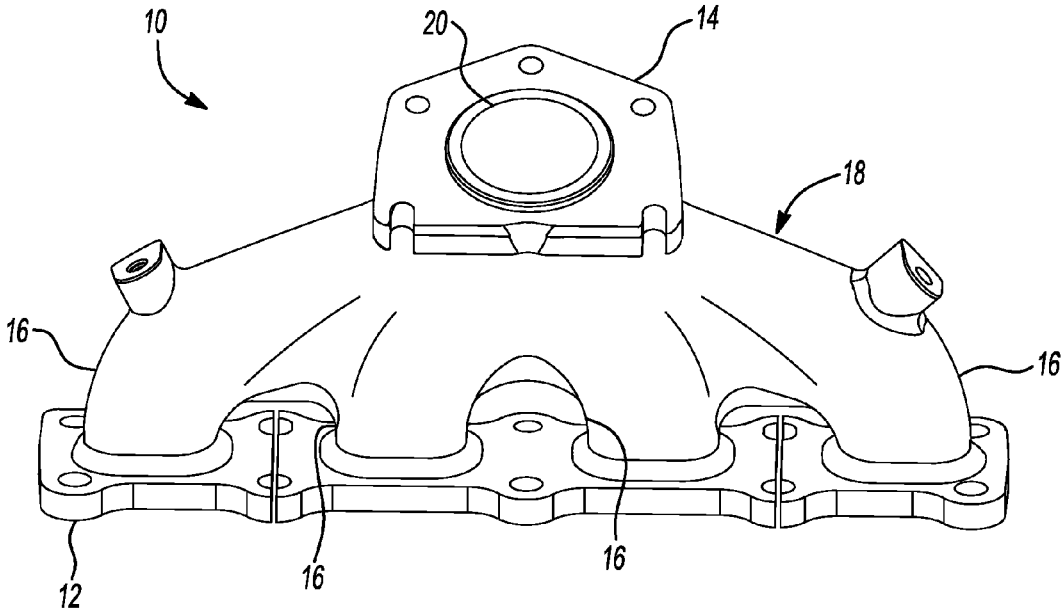
Fig-1 PRIOR ART
FIG. 1 is a perspective view of a typical exhaust manifold.

The following description is merely exemplary in nature and is not intended to limit the present disclosure, application, or uses. It should be understood that throughout the drawings, corresponding reference numerals indicate like or corresponding parts and features. While reference to the subject invention is made herein in the context of exhaust manifolds, it should be understood and appreciated that the features and attributes described in the present disclosure may be employed in any of a variety of exhaust components and are not limited to the exhaust manifolds illustrated and described herein.

Referring to FIG. 1, a typical exhaust manifold is illustrated and generally indicated by reference numeral 10. The exhaust manifold 10 includes an inlet flange 12, an outlet flange 14, four runners 16 (also called exhaust passageways), and a collector 18. The inlet flange 12 is to be mounted to a cylinder head of an internal combustion engine (not shown) for receiving exhaust gas from the engine. The outlet flange 14 is to be mounted to an exhaust system (not shown) for releasing the exhaust gas to the environment. The runners 16 merge at the collector 18 so that the exhaust gas from the engine and the runners 16 is collected in the collector 18 and then exits at an outlet 20 formed in the outlet flange 14.

When the exhaust gas flows through the exhaust manifold 10, the exhaust manifold 10 suffers significant thermal stress due to heat transfer from the exhaust gas to the exhaust manifold 10. The heat transfer from the exhaust gas to the manifold 10 is not uniform so that certain areas of the manifold 10 are much hotter than other areas.

Figure 2:
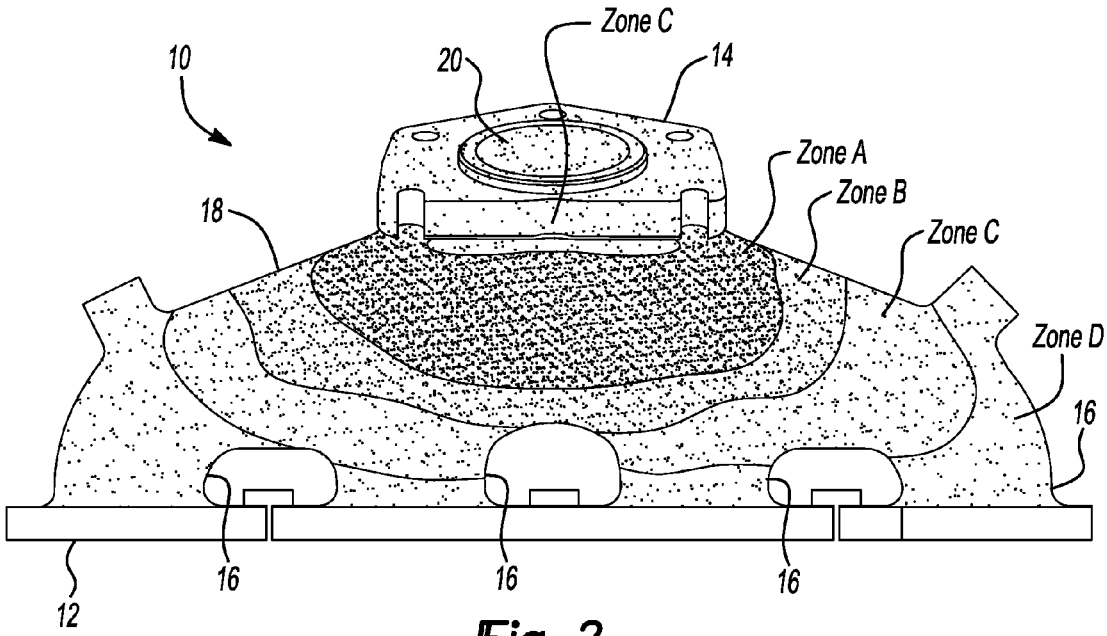
Fig-2 PRIOR ART
FIG. 2 illustrates a typical steady state temperature distribution for a typical exhaust manifold.

FIG. 2 shows a steady-state temperature distribution for the manifold 10. Zone A indicates the highest temperature zone, which occurs in the region of the collector 18 proximate to the outlet 20. Zone B has the second highest temperature and covers certain portions of the collector 18. Zone C covers the outlet and certain portions of the runners 16. Zone D has the lowest temperature. Therefore, Zone A, which covers the region of the collector 18 proximate to the outlet 20 is more susceptible to damage.

Figure 3:
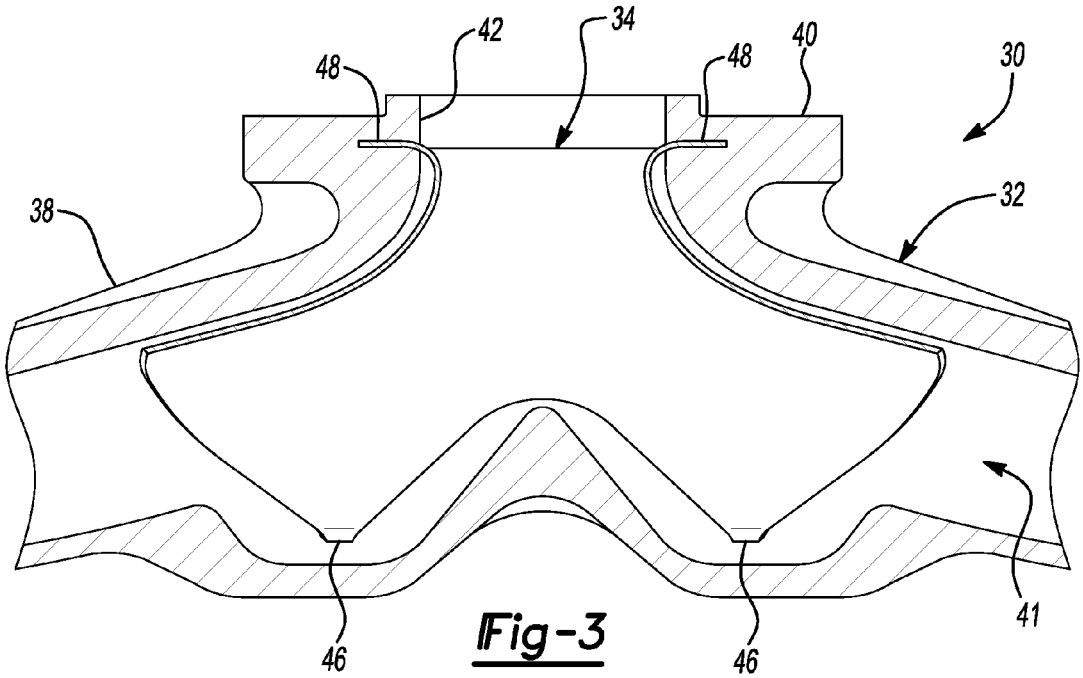
FIG. 3 is a partial cutaway side view of an exhaust manifold in accordance with a first embodiment of the present disclosure.
Figure 4:
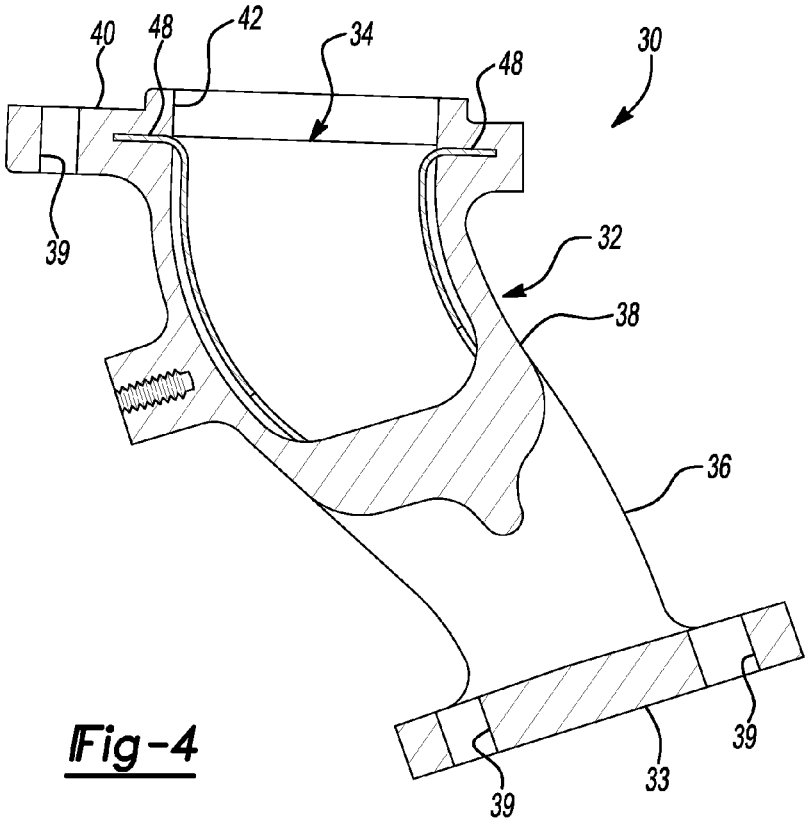
FIG. 4 is a cutaway end view of an exhaust manifold in accordance with a first embodiment of the present disclosure.

Referring to FIGS. 3 and 4, an exhaust component according to a first embodiment of the present disclosure is illustrated and generally indicated by reference numeral 30. The exhaust component is in the form of an exhaust manifold 30 and includes a manifold body 32 (or a component body) and a heat shield insert 34. The manifold body 32 includes an inlet flange 33 (only shown in FIG. 4), a plurality of inlet pipes 36 (only one is shown in FIG. 4), a collector 38, and an outlet flange 40. The outlet flange 40 defines an outlet 42. The inlet pipes 36 are also called "exhaust passageways" or "exhaust runners". The manifold body 32 defines a gas chamber 41 which extends from the inlet pipes 36, through the collector 38 to the outlet 42. The inlet flange 33 defines passageways communicating the exhaust ports of the cylinder head of the engine to the inlet pipes 36. A plurality of holes 39 are formed in the inlet flange 34 and the outlet flange 40 so that a plurality of fasteners (not shown) can be inserted into the holes 39 to secure the inlet flange 33 to the cylinder head and to secure the outlet flange 40 to an adjacent component. The inlet pipes 36 have one end joined to the inlet flange 33 and the other end joined to the collector 38.

The exhaust manifold 30 collects the exhaust gases from the engine and directs the exhaust gases toward an exhaust system, which typically includes a collection of pipes for emitting exhaust gases to the environment. Depending on the overall system design, the exhaust gases may flow through a turbocharger to increase engine power, an emissions system to reduce air pollution, and/or a muffler to reduce noise, before the exhaust gases are released to the environment.

The manifold body 32 is preferably made of a cast iron and formed in one casting step due to its low cost, among other things. A cast iron suitable for the exhaust component includes silicon-molybdenum cast iron. The internal heat shield insert 34 is sculpted to have different shapes depending on the configuration of the exhaust manifold. Preferably, the internal heat shield insert 34 is formed by a stamping or hydroforming process and has a shape conforming to an adjacent inner surface of the manifold body 32.

The heat shield insert 34 is provided in the collector 38 and proximate to the outlet 42. The heat shield insert 34 has a plurality of insert edges, preferably in the form of tabs 46, embedded into the component 32 to secure the heat shield insert 34 to the manifold body 32. Because the typical areas that are prone to the highest temperatures and/or largest thermal gradients are collector regions adjacent to the outlet flange 40, by providing the heat shield insert 34 in these regions, the casting body is protected from premature failure due to the high heat in these regions.

The suitable materials for the heat shield insert 34 include materials that are higher grade and more heat-resistant than the material for the manifold body 32. Preferably, the heat shield insert 34 is made of austenitic stainless steel. Other possible materials for the heat shield insert include, by way of example, ferritic stainless steel, ceramic, or other refractory materials.

Preferably, the heat shield insert 34 is secured to the manifold body 32 during casting of the manifold body 32. In this embodiment, the heat shield insert 34 is inserted into the mould and when the cast material is poured, the cast material forms a bond (mechanical, physical, metallurgical, and/or chemical) along all of or some of the edges.

In the configuration shown in FIGS. 3 and 4, there is complete edge bonding 48 at the outlet 42 and partial edge bonding (only at discrete tabs 46) along the other edge. This strategy holds the heat shield insert 34 to prevent rattling or vibration/movement issues such as NVH problems; prevents the insert from falling out during shipping and assembly; and does not over-constrain the insert so as to avoid potential thermal stress durability issues. There may or may not be a distinct air gap between the insert 34 and the main manifold material. The air gap and/or contact resistance will effectively reduce the heat transfer from the exhaust gases to the manifold material.

Figure 5:
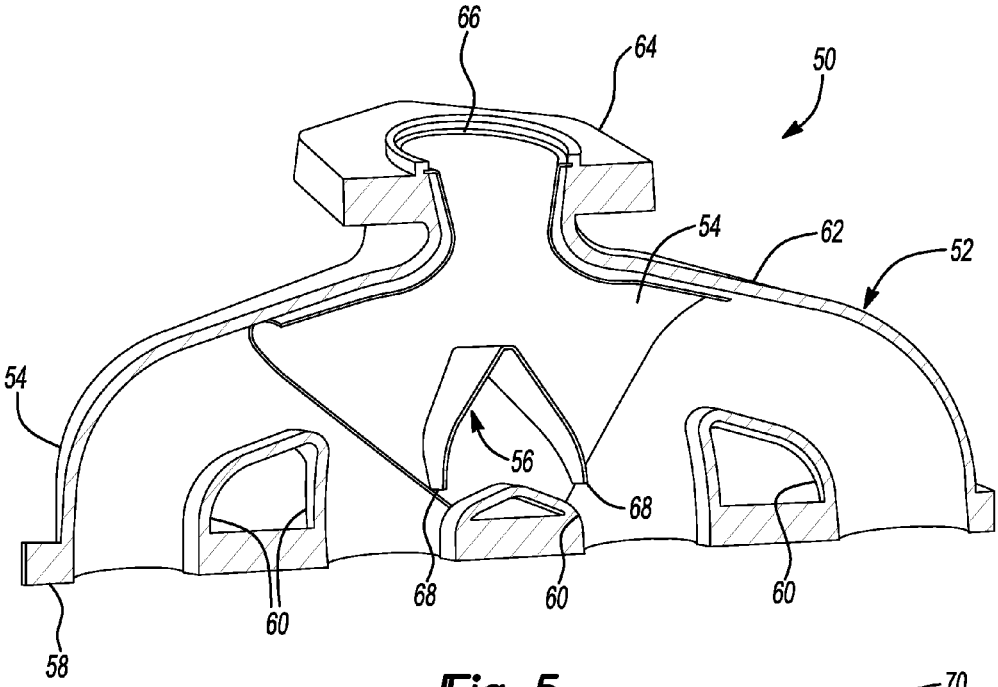
FIG. 5 is a cutaway oblique view of an exhaust manifold in accordance with a second embodiment of the present disclosure.

Referring to FIG. 5, an exhaust component according to a second embodiment of the present disclosure is illustrated and generally indicated by reference numeral 50. The exhaust component is in the form of an exhaust manifold 50 includes a manifold body 52, a first heat shield insert 54 and a second heat shield insert 56. The manifold body 52 includes an inlet flange 58, four inlet pipes 60, a collector 62, and an outlet flange 64 which defines an outlet 66. The manifold body 52 is preferably made of cast iron.

Similar to the heat shield insert 34 of the first embodiment, the first heat shield insert 54 of this embodiment is provided in the collector 62 proximate to the outlet 66 and covers the inner surface of the outlet 66 and a portion of the collector 62. The second heat shield insert 56 is preferably a metal sheet bent to form a triangular configuration. The second heat shield insert 56 is provided proximate to the intersection of the middle two inlet pipes 60 and has two guiding arms 68 disposed along the flow paths of the exhaust gas for directing the exhaust gas from the middle two inlet pipes 60 to the outlet 66. By directing the exhaust gas flow toward the outlet 66, the local heat transfer coefficient can be reduced as well as reducing the pressure losses in the component. Because the heat transfer is reduced, the collector 62 is further protected from heat-induced damage. It should be noted that the shape of the manifold body of this embodiment has been simplified and the first heat shield 54 is made larger to cover a greater portion of the manifold material.

Like the heat shield 34 of the first embodiment, the first heat shield insert 54 can be secured to the manifold body 52 by a complete edge bonding or by discrete tabs along the edges. The second heat shield insert 56 is preferably welded at certain points to the first heat shield insert 54 after the manifold body 52 is formed.

It should be understood and appreciated that one or more heat shield inserts can be advantageously placed in the collector regions, runner intersections, gas impingement regions, runner regions with reduced cross sectional area, and common (shared) walls between exhaust runners or bifurcations that separate plenums/chambers/runners in the manifold.

Figure 6:
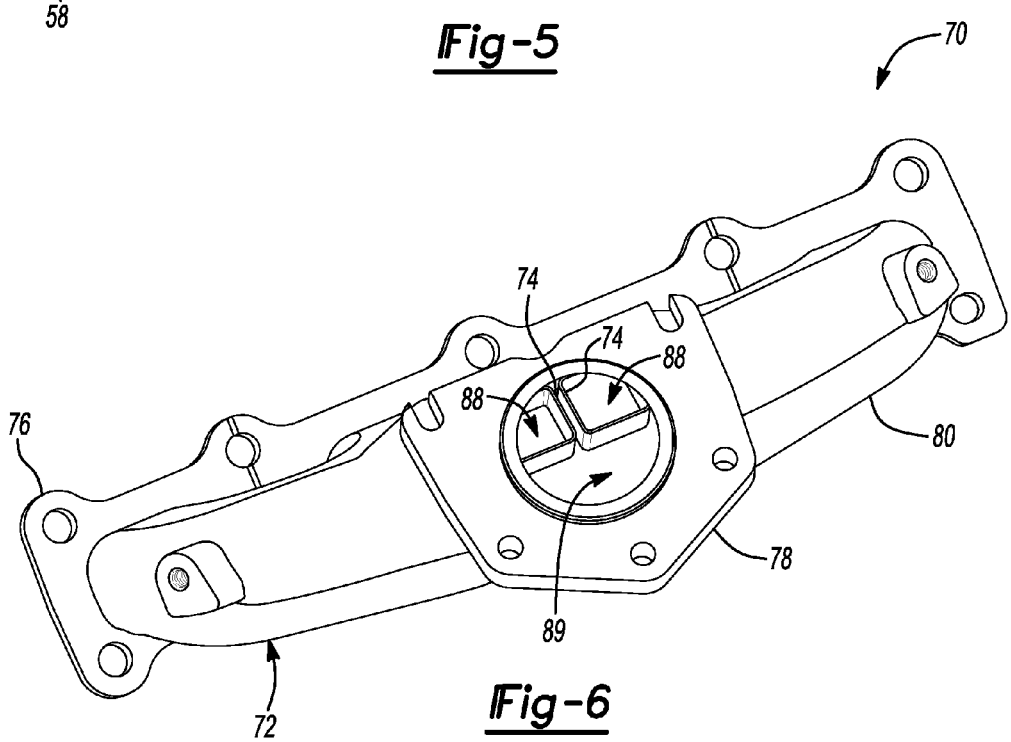
FIG. 6 is a perspective view of an exhaust manifold in accordance with a third embodiment of the present disclosure.
Figure 7:
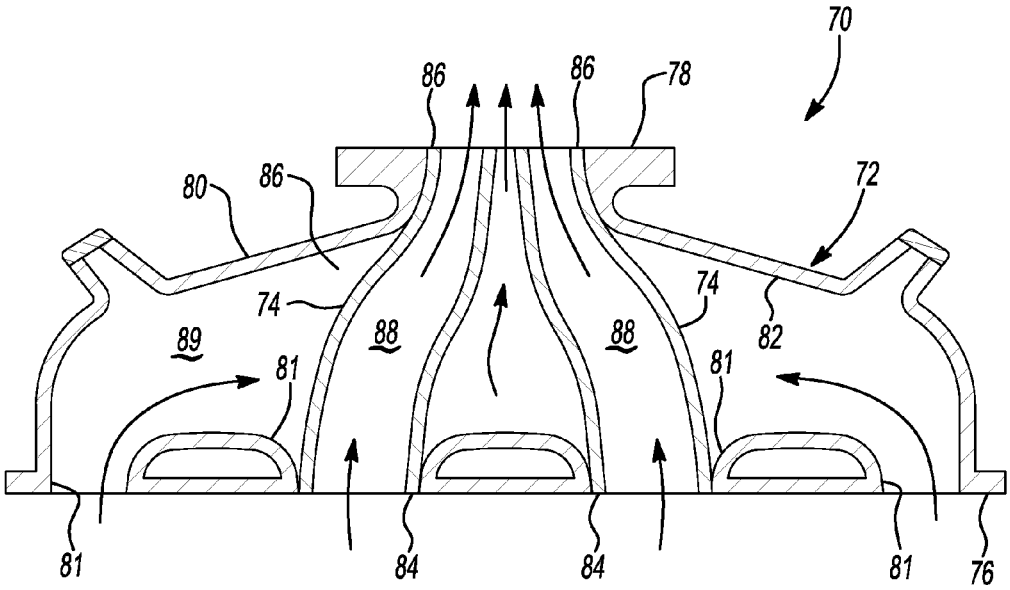
FIG. 7 is a cross-sectional view of an exhaust manifold in accordance with the a third embodiment of the present disclosure.

Referring to FIGS. 6 and 7, an exhaust component according to a third embodiment of the present disclosure is depicted as an exhaust manifold and generally indicated by reference numeral 70. The exhaust manifold 70 includes a manifold body 72 and two tubular inserts 74. The manifold body 72 includes an inlet flange 76, an outlet flange 78, and a collector 80 between the inlet flange 76 and the outlet flange 78. The inlet flange 76 defines four passageways 81 communicating to the gas chamber 82 defined in the collector 80. In this embodiment, the exhaust manifold 70 does not have inlet pipes between the inlet flange 76 and the collector 80. Each of the tubular inserts 74 has an inlet end 84 and an outlet end 86. The inlet ends 84 are inserted into the middle two passageways 81 of the inlet flange 76 and the outlet ends 86 are connected to an outlet of the outlet flange 78. The tubular inserts 74 define two tubular channels 88 from the inlet flange 76 to the outlet flange 78. A secondary channel 89 is thus formed between the two tubular inserts 74 and the inner surface of the manifold body 72. The secondary channel 89 extends from the two passageways 81 adjacent to the opposing ends of the inlet flange 76 to the outlet flange 78. The tubular channels 88 direct 50% of the exhaust gas and the secondary channel 89 direct the remaining 50% of the exhaust gas.

With the internal heat shield insert, even though the manifold body 72 is in direct contact with some of the exhaust gases, the operating temperature will be lower than if the material was in contact with the exhaust gas from all of the runners. The tubular inserts 74 could be, for example, stainless steel or ceramic, and they could be cast in place in the case of a cast manifold, or inserted into a cast body as an assembly step for either a fabricated or cast exhaust manifold.

While the two tubular inserts 74 are shown to be separate, they can be joined at the outlet of the outlet flange 78.

Figure 8:
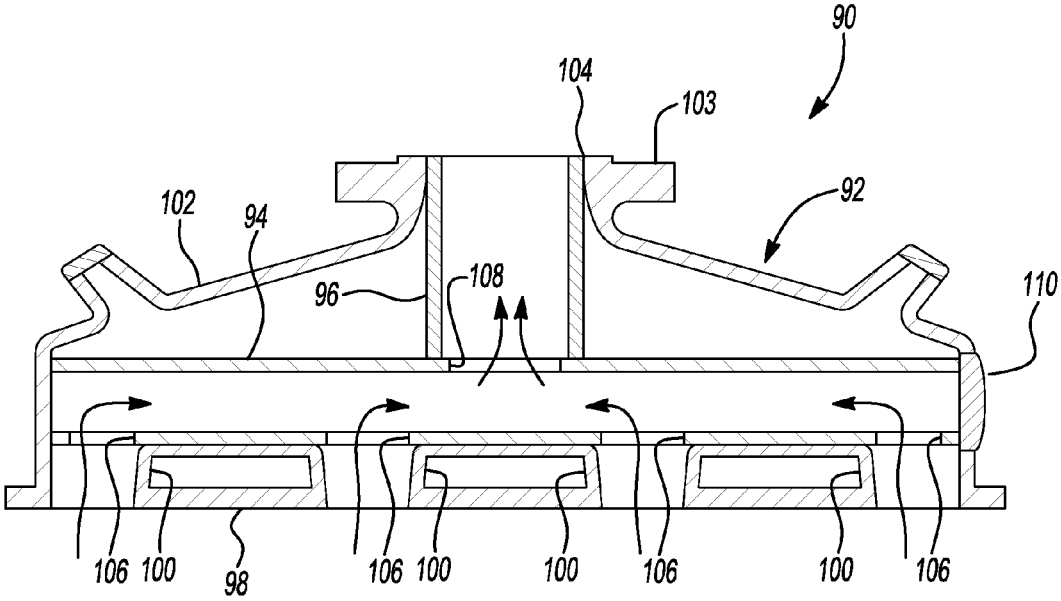
FIG. 8 is a cross-sectional view of an exhaust manifold in accordance with a fourth embodiment of the present disclosure.
Figure 9:
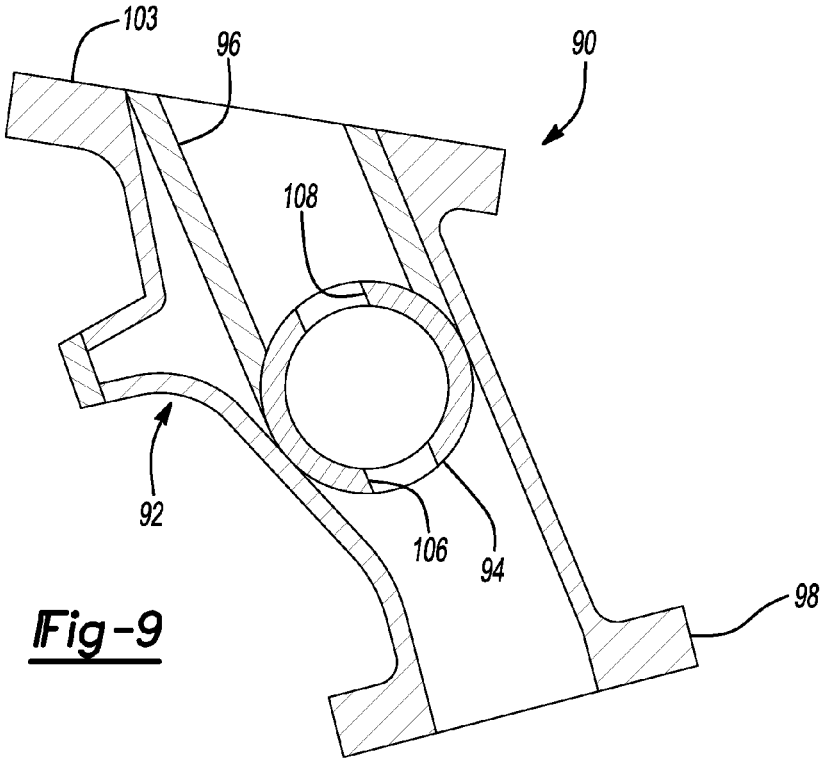
FIG. 9 is another cross-sectional view of an exhaust manifold in accordance with a fourth embodiment of the present disclosure.

Referring to FIGS. 8 and 9, an exhaust component in the form of an exhaust manifold according to a fourth embodiment of the present disclosure is depicted and generally indicated by reference numeral 90. The exhaust manifold 90 includes a manifold body 92, a first tubular insert 94 and a second tubular insert 96. The manifold body 92 includes an inlet flange 98, four runners 100 connected to the inlet flange 98, a collector 102 at which the runners 100 merge, and an outlet flange 103 defining an outlet 104. In this embodiment, the first tubular insert 94 is a collector tube and the second tubular insert 96 is an outlet tube. The collector tube 94 has a length substantially equal to the length of the collector 102 and engages the inner wall of the collector 102. The collector tube 94 and the outlet tube 96 can be cast in place or inserted after the manifold body 92 is completed. The collector tube 96 has four first side openings 106 communicating to the gas passageways of the runners 100 and one second opening 108 communicating to the outlet tube 96. The exhaust gases are guided from the runners 100, through the collector tube 94 to the outlet tube 96 and leave the exhaust manifold 90. In the presence of the collector tube 94 and the outlet tube 96 as heat shield inserts, most or all the exhaust gases from the runners 100 flow into the common collector tube 94 and is then directed to the outlet tube 96. Therefore, the heat transferred to the manifold material can be significantly reduced.

In the present embodiment, the collector tube 94 and the outlet tube 96 are inserted during the assembly step. The collector tube 94 is inserted from an insertion hole of the manifold body 92 and the outlet tube 96 is inserted from an outlet of the outlet flange 103. Preferably, the collector tube 94 is welded to an adjacent wall of the manifold body 92 around the insertion hole or otherwise sealed to the main manifold material to provide a leak-free assembly. Similarly, the outlet tube 96 may be welded to an adjacent wall of the outlet flange 103. After the collector tube 94 and the outlet tube 96 are secured to the manifold body, an end cap 110 is welded to the manifold body to close the insertion hole.

In the case when an air gap exists between the heat shield inserts 94 and 96 and the main manifold material and there is a complete edge bonding of the inserts 94 and 96, the exhaust gases are prevented from coming into the manifold material behind the insert. In the case when an air gap exists between the inserts 94 and 96 and the main manifold material and there is not complete edge bonding of the insert, the exhaust gases can come into contact with the manifold material behind the inserts 94 and 96. In this case, it is believed that the flow rate and velocity of the exhaust gases in this region will be sufficiently small so that the insert will still provide adequate shielding to effectively keep the main manifold material at a lower temperature than would result from not using the inserts 94 and 96.

Figure 10:
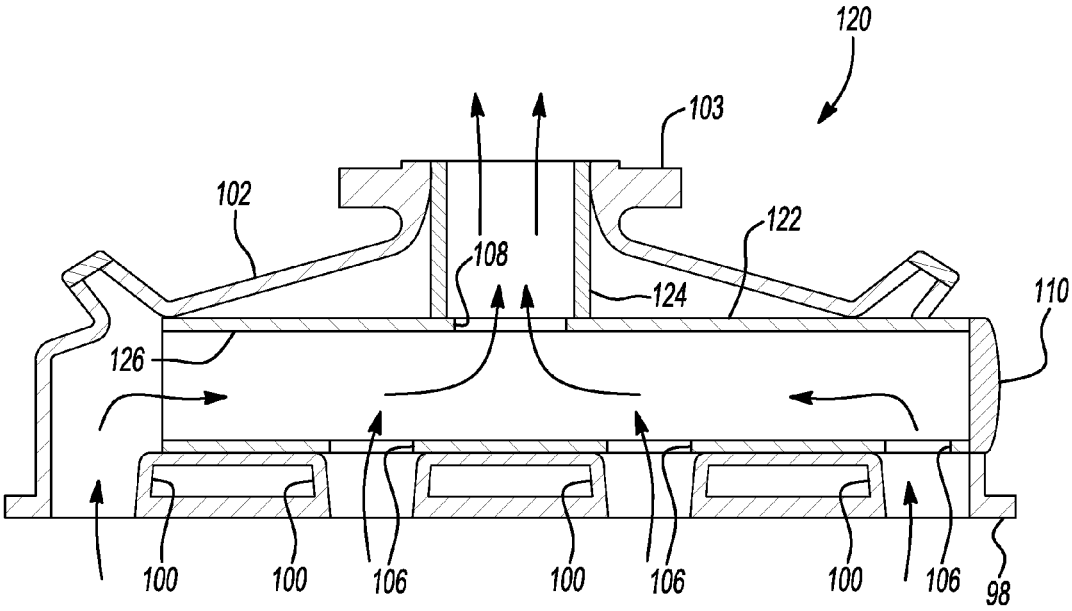
FIG. 10 is a cross-sectional view of an exhaust manifold in accordance with the fifth embodiment of the present disclosure.

Referring to FIG. 10, an exhaust manifold according to a fifth embodiment of the present disclosure is illustrated as an exhaust manifold and generally indicated by reference numeral 120. The exhaust manifold has a structure similar to that of the exhaust manifold of FIGS. 8 and 9 except for the collector tube 122. In this embodiment, the collector tube 122 does not extend to the left end of the collector 102. Therefore, the exhaust gas from the first runner 100 at the left side of FIG. 10 flows into the collector tube 122 through an end opening 126, rather than from a side opening 106. In any event, with the presence of the collector tube, the heat of the exhaust gases can be partly absorbed by the collector tube 122 and the outlet tube 124 so as to fully or partially insulate the exhaust gas from the manifold body and protect the manifold body from heat-induced damages.

In accordance with the teachings of the present disclosure, the exhaust components such as exhaust manifolds can be made using a combination of different materials. The use of different materials allows for a low cost material (typically with lower temperature capability) to be used for most of the structure of the exhaust component, and a higher grade, more temperature resistant material, in regions of high temperature or high thermal gradients to protect the lower cost material.

By integrating the internal heat shields into the regions that are subjected to high thermal gradients that can fail prematurely due to cyclic thermal mechanical fatigue, the manifolds can be made of low-cost materials while maintaining sufficient thermal strength in the region that is prone to the highest temperatures/thermal strain and largest thermal gradients. Protecting the cast iron in the high temperature/high thermal strain regions with an internal heat shield would result in a more cost effective solution than upgrading the material of the entire manifold.

While not shown in the figures, a third tubular insert can be provided inside one or all of the runners. The third tubular insert can be made to extend along the entire length or only a fraction of the inlet pipes. The collector tube, the outlet tube and the third runner tube(s) can be made of the same or different materials.

While not shown in the figures, it is understood and appreciated that for certain manifold geometry, it may be possible to place the internal heat shield into position after the main manifold has been constructed, either by casting or by fabricating. By way of example, when a manifold is provided with a large outlet connected to a close catalytic converter, the internal heat shield can be inserted into the manifold through the outlet by the spring-back action of the heat shield if the internal heat shield is made of a metal. It is also possible to secure the internal shield in the manifold by welding or other locking/holding features.

It should be understood and appreciated that while the several embodiments generally relate to exhaust manifold applications, the general concepts discussed herein are also applicable to other "exhaust components" such as turbochargers, by way of non-limiting example. Additionally, while each of the embodiments depicted pertain to cast manifold applications, it should also be recognized that the internal heat shield insert may be useful in "fabricated exhaust component assemblies," which are formed by fabricating.

Accordingly, the description of the present disclosure is merely exemplary in nature and, thus, variations that do not depart from the gist of the present disclosure are intended to be within the scope of the present disclosure. Such variations are not to be regarded as a departure from the spirit and scope of the present disclosure.

What is claimed is:

1. An exhaust component for receiving exhaust gas from a cylinder head of an internal combustion engine, the exhaust component comprising:

a component body defining a gas chamber and first and second runners feeding the gas chamber, the first and second runners being integrally formed with the gas chamber, the component body being structurally configured to be mounted to the cylinder head, the first and second runners being fluidly coupled with a source of exhaust gas; and a shield insert disposed in the gas chamber for dividing the gas chamber into a first flow channel inside the shield insert and a second flow channel at least partially surrounding the first flow channel and defined by the shield insert and the component body, the first and second flow channels receiving exhaust gas from the first and second runners, respectively, wherein the first runner and the first flow channel define a first exhaust flow path, and wherein the second runner and the second flow channel define a second exhaust flow path, and wherein the first and second exhaust flow paths are fluidly isolated from each other, and wherein the component body is formed from a first material and the shield insert is formed from a second material that is more heat-resistant than the first material.

2. The exhaust component of claim 1, wherein the shield insert has a tubular configuration defining the first flow channel inside the shield insert.

3. The exhaust component of claim 1, wherein the shield insert includes two tubes defining the first flow channel in one of the two tubes and a third flow channel in the other of the two tubes.

4. The exhaust component of claim 1, wherein the component body includes a third runner and the shield insert defines a third flow channel in the gas chamber, and wherein the third runner and the third flow channel define a third exhaust flow path that is fluidly isolated from the first exhaust flow path.

5. The exhaust component of claim 4, wherein the component body includes a fourth runner and the shield insert defines a fourth flow channel in the gas chamber, and wherein the fourth runner and the fourth flow channel define a fourth exhaust flow path that is fluidly isolated from the first and third exhaust flow paths.

* * * * *